United States Patent [19]

Merz et al.

[11] 4,087,778

[45] May 2, 1978

[54] TERMINATION FOR ELECTRICAL RESISTOR AND METHOD OF MAKING THE SAME

[75] Inventors: Kenneth M. Merz, Gladwyne; Howard E. Shapiro, Philadelphia, both of Pa.

[73] Assignee: TRW Inc., Cleveland, Ohio

[21] Appl. No.: 674,046

[22] Filed: Apr. 5, 1976

[51] Int. Cl.[2] ..... H01C 1/012

[52] U.S. Cl. ..... 338/309; 29/621; 252/512; 252/515; 252/516; 338/328; 427/374 C

[58] Field of Search ..... 338/322, 327, 328, 307, 338/308, 309; 29/619, 621; 252/512, 513, 515, 516, 518, 519, 520; 106/47–49; 427/374 C, 374 F, 376 B, 383 R, 383 B, 380, 404, 403, 123, 101, 126, 102, 103; 428/433

[56] References Cited

U.S. PATENT DOCUMENTS

| | | | |
|---|---|---|---|
| 3,394,087 | 7/1968 | Huang | 252/512 |
| 3,441,516 | 4/1969 | Mulligan et al. | 252/512 |
| 3,649,945 | 3/1972 | Waits | 338/309 |
| 3,794,518 | 2/1974 | Howell | 252/512 |
| 3,886,578 | 5/1975 | Eastwood et al. | 252/512 X |
| 3,914,514 | 10/1975 | Mackenzie | 252/518 X |

*Primary Examiner*—C. L. Albritton
*Attorney, Agent, or Firm*—Jacob Trachtman

[57] ABSTRACT

A termination material for a vitreous enamel electrical resistor includes a mixture of a glass frit and particles of either molybdenum, tungsten, tantalum or titanium. The termination material is applied to a substrate and fired to melt the glass frit, and then cooled to form a layer of the glass with the metal particles embedded therein. The termination material may be applied to the substrate either before or after the resistance material is applied to the substrate and is particularly useful with vitreous enamel resistance materials which include either a mixture of tantalum nitride and tantalum, a mixture of tungsten carbide and tungsten, or an alloy of copper and nickel.

23 Claims, 3 Drawing Figures

TERMINATION FOR ELECTRICAL RESISTOR AND METHOD OF MAKING THE SAME

The present invention relates to a conductive termination for an electrical resistor and method of making the same, and particularly to a vitreous enamel termination for a vitreous enamel resistor and method of making the same.

A type of resistance material which has come into use is the vitreous enamel resistance material which comprises a mixture of particles of a conductive material and a glass frit. To form a resistor, the vitreous enamel resistance material is applied to a substrate and fired to melt the glass frit. When cooled, the resistor is a layer of glass having the conductive particles dispersed throughout the glass. Initially the conductive particles were of noble metals, such as gold, platinum, silver etc., including mixtures and alloys of such noble metals, to provide a resistor having good electrical characteristics. To reduce the cost of the resistance materials, there were then developed vitreous enamel resistance materials in which non-noble metals were used as the conductive particles. For example, U.S. Pat. No. 3,394,087 to C. Y. D. Huang et al, issued July 23, 1968, entitled, "Glass Bonded Resistor Compositions Containing Refractory Metal Nitrides and Refractory Metal" discloses the use of tantalum nitride and tantalum as the conductive particles, and U.S. Pat. No. 3,180,841 to R. M. Murphy et al, issued Apr. 27, 1965 entitled "Resistance Material and Resistor Made Therefrom" discloses the use of tungsten carbide and tungsten as the conductive particles.

In order to make electrical connection to the vitreous enamel resistors, it is desirable to provide the resistor with conductive terminations which are applied to the substrate at the ends of the resistor. Such terminations should be highly conductive and compatible with the particular material of the resistor both chemically, and as to the manner of applying the termination and the resistance material. Good terminations have been achieved with materials containing noble metals. However, these materials are expensive. There are available termination materials based upon copper and nickel. However, these terminations have been found not to be completely compatible with certain vitreous enamel resistance materials, such as those containing tantalum nitride and tantalum as the conductive material.

Therefore it is an object of the present invention to provide a novel termination material for electrical components, such as resistors.

It is another object of the present invention to provide a noel vitreous enamel termination material.

It is still another object of the present invention to provide a vitreous enamel termination material which does not contain a noble metal so as to be relatively inexpensive.

It is a further object of the present invention to provide a vitreous enamel termination material which is compatible with vitreous enamel resistance materials, such as those containing as the conductive material either tantalum nitride and tantalum, tungsten carbide and tungsten, or an alloy of copper and nickel.

It is still a further object of the present invention to provide a vitreous enamel termination material which can be applied to a substrate either before or after the resistance material.

It is yet another object of the present invention to provide a vitreous enamel termination material which includes a mixture of particles of a glass frit and either molybdenum, tungsten, tantalum or titanium.

Other objects will appear hereinafter.

The invention accordingly comprises a composition of matter and the product formed therewith possessing the characteristics, properties and relation of constituents which will be exemplified in the composition hereinafter described, and the scope of the invention will be indicated in the claims.

For a fuller understanding of the nature and objects of the invention, reference should be had to the following detailed description taken in connection with the accompanying drawing in which.

Figure 1:
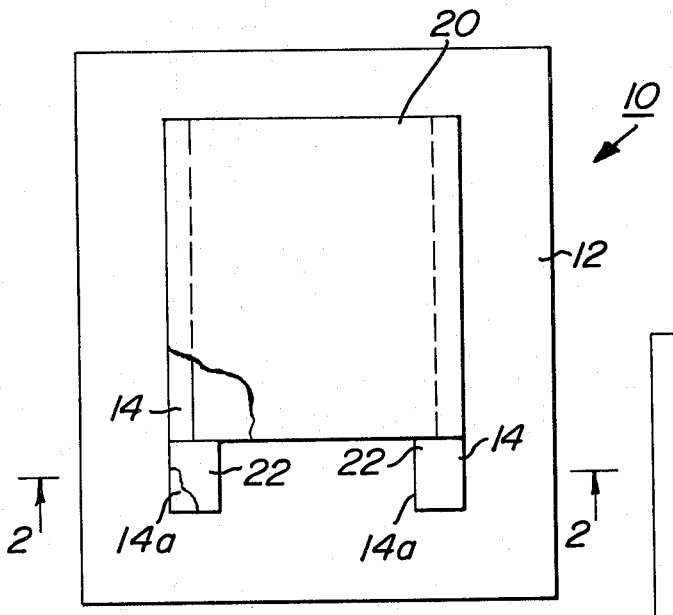
FIG. 1 is a top plan view of one form of an electrical resistor having the termination of the present invention.

In general, the termination material of the present invention comprises a mixture of a glass frit and fine particles of either molybdenum, tungsten, tantalum, or titanium. The metal particles may be present in the mixture in the amount of 45% to 80% by volume, but is preferably present in the amount of 45% to 65% by volume.

The glass frit used in the termination material of the present invention may be of any well known composition which has a melting temperature below that of the metal particles. The glass frits most preferably used are the borosilicate frits, such as bismuth, cadmium, barium, calcium or other alkaline earth borosilicate frits. The preparation of such glass frits is well known and consists, for example, in melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

To make the termination material of the present invention, glass frit and −325 mesh particles of either molybdenum, tungsten, tantalum or titanium, in the desired proportions, are thoroughly mixed together, such as by balling milling in an organic medium, such as butyl carbitol acetate. The organic medium is then drained from the mixture and the mixed particles are dried at a temperature of 100° C to 110° C for 8 to 12 hours to remove any remaining organic medium. The mixture of the glass frit and the metal particles are then mixed with a vehicle suitable for the desired manner of applying the termination material. For example, the mixture can be mixed with a Reusche squegee medium for applying the termination material by screen printing.

To terminate an electrical component, such as an electrical resistor, the termination material is applied to the surface of a substrate. The substrate may be a body of any material which will withstand the firing temperature of the termination material as wel as the temperature and conditions required to apply the resistance material. The substrate is generally a body of a ceramic material, such as glass, porcelain, steatite, barium titinate, alumina or the like. The termination material may be applied on the substrate by brushing, dipping, spraying or screen printing application. The termination material is then dried to remove any liquid vehicle, such as by heating at 150° C for 5 to 15 minutes. If desired, the termination material on the substrate can then be heated to about 350° C in a nitrogen atmosphere for about ½ hour to remove any organic binder in the material. The termination material is then fired in a conventional furnace to a temperature at which the glass frit becomes molten. The termination material is preferably fired in an inert atmosphere, such as nitrogen. Although the firing temperature depends on the melting temperature of the glass frit used, for borosilicate glass frits, the termination material is generally fired at a temperature of 1100° C to 1200° C over a cycle of ½ hour to 1 hour. When the substrate and termination material are cooled, there is provided a termination which is a layer of glass having the particles of the metal embedded in and dispersed throughout the glass.

Although the termination material of the present invention can be used to terminate any type of electrical component, it is particularly useful for terminating vitreous enamel resistors wherein the resistance material is a layer of glass having conductive particles embedded in and dispersed throughout the glass layer. More particularly, the termination material of the present invention is most useful in terminating a vitreous enamel resistor in which the conductive particles are either a mixture of tantalum nitride and tantalum, a mixture of tungsten carbide and tungsten, or an alloy of copper and nickel. The resistance material is applied to the substrate using a technique which may be suitable for the particular resistance material, with the resistance material contacting and preferably overlapping, the termination material. The termination material of the present invention can be applied to the substrate either before the resistance material is applied or after the resistance material is applied.

Figure 2:
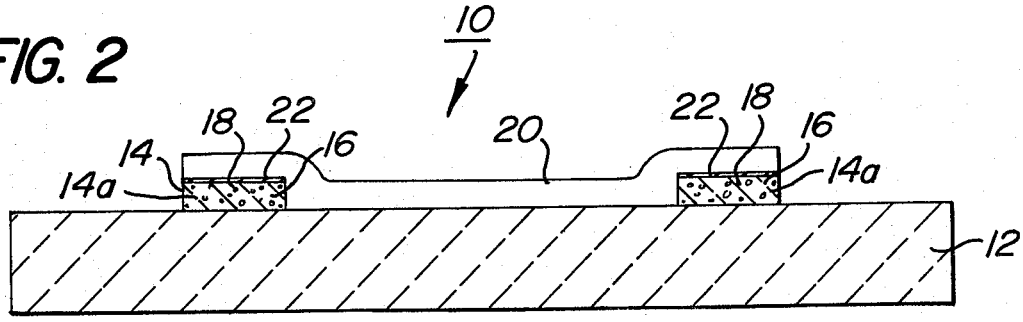
FIG. 2 is a sectional view taken along line 2—2 of FIG. 1.

Referring to FIGS. 1 and 2 of the drawing, one form of a resistor using the termination material of the present invention is generally designated as 10. Resistor 10 includes a flat substrate 12 of a ceramic material. On a surface of the substrate 12 are two spaced termination areas 14 of the termination material of the present invention. Each of the termination areas 14 comprises a layer 16 of glass having metal particles 18 embedded in the glass. On the surface of the substrate 12 between the termination areas 14 is a resistance material layer 20. The resistance material layer 20 overlies each of the termination areas 14 so as to make contact therewith. A portion **14*a* of each termination area 14 is not covered by the resistance material layer 20 to allow contact to be made to the termination areas. The uncovered portions 14*a* of the termination areas 14 are coated with a layer 22 of a conductive metal which is easily wetted with solder, such as nickel. Terminals can be soldered to the metal coated portions 14*a*** of the termination areas and the entire resistor encapsulated in a protective material, such as a plastic.

Figure 3:
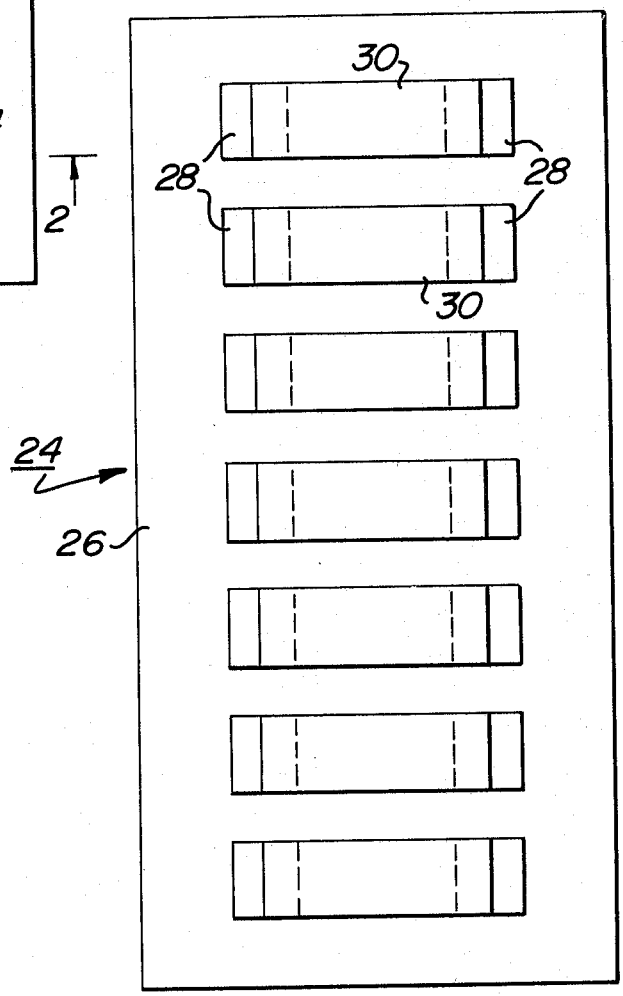
FIG. 3 is a top plan view of another form of an electrical resistor having the termination of the present invention.

Referring to FIG. 3, another form of a resistor utilizing the termination material of the present invention is generally designated as 24. Resistor 24 includes a flat substrate 26 of a ceramic. On a surface of the substrate 26 are a plurality of rectangular termination areas 28 of the termination material of the present invention. The termination areas 28 are arranged in two spaced, parallel rows with each termination area in one row being directly opposite to a termination area in the other row, to form a plurality of spaced pairs of the termination areas. On the surface of the substrate 26 between each pair of termination areas 28 is a separate resistance material layer 30. Each resistance material layer 30 overlaps and contacts a portion of each of its respective termination areas 28. The uncovered portions of the termination areas 28 are coated with a layer of a metal which is easily wetted by solder, such as nickel. Terminals can be soldered to the metal coated termination areas and the resistor encapsulated in a protective covering. Although the resistor 24 is shown as having seven resistance material layers 30, it can have any desired number of such resistance material layers. Also, the resistance material layers 30 can be of the same resistance material or different resistance materials, and can all be of the same resistance value or different resistance values.

The following examples are given to illustrate certain preferred details of the invention, it being understood that the details of the examples are not to be taken as in any way limiting the invention thereto.

EXAMPLE I

A termination material was made by mixing together particles of molybdenum and a glass frit with the molybdenum being present in the amount of 49% by volume. The glass frit was of the composition of, by weight, 2% calcium oxide, 10% magnesium oxide, 30% boron oxide, 14% aluminum oxide, and 44% silica. The glass frit and molybdenum were thoroughly mixed together in a ball mill with butyl carbitol acetate. After removing the liquid vehicle, the mixture was mixed with a squeegee medium for screen printing application. The termination material was applied to substrates by screen printing to provide on the substrate, a plurality of termination areas in the pattern shown in FIG. 3. The termination areas were dried in an air atmosphere at 150° C for ¼ hour, and then fired at 1150° C in an atmosphere of forming gas (95% hydrogen and 5% nitrogen) over a one hour cycle.

Resistance material layers were then applied to the substrates between and overlapping the termination areas by screen printing. The resistance material layers were of a mixture of a glass frit and a mixture of particles of tantalum nitride and tantalum. The resistance material layers were dried in an air atmosphere at 150° C for ¼ hour and then heated at 350° C, in an atmosphere of nitrogen, over a ½ hour cycle to remove any organic binder. The resistors were then fired at 1150° C, in a nitrogen atmosphere, over a ½ hour cycle.

The uncovered portions of the termination areas were coated with a layer of nickel by electroless plating and the nickel layers were tinned. Terminals were soldered to the terminal areas and the resistors were encapsulated in a protective covering.

The resistors were subjected to various tests to determine the stability of the resistors, and compatibility of the termination areas with the resistance material layer. These test included temperature coefficient of resistance (TCR), short term overload (STOL), low temperature operation (LTO), and load life (LL) tests which are standard tests described in military specification MIL-R-83401B. To determine the TCR, the resistance of the resistors are measured at room temperature, at −55° C, and at +125° C to find the changes in resistance as a result of the change in temperature. For the STOL test, the resistors are subjected to a voltage of about 2.5 times the rated continuous working voltage for about 5 seconds, and the resistance of the resistors are measured before and after the test to determine any change in resistance. For the LTO test, the resistors are cooled to about −65° C and full rated continuous working voltage is applied for about 45 minutes. After removal of the voltage, the resistors are gradually raised to room temperature, and when fully stabilized at room temperature, the resistances are measured to determine any changes in resistance. For the load life test, the resistors are heated to about 70° C and a working voltage is intermittently applied to the resistors with the voltage being applied for 1½ hours, and being off for ½ hour, for each cycle. The resistance of the resistors is measured at various time intervals.

The test results for these resistors are shown in Table I.

Table I

| | Average | Span | |
|---|---|---|---|
| TCR (parts/million/° C) | | | |
| −55° C | 109 | 124 | 95 |
| +125° C | 64 | 72 | 57 |
| LTO (% change in resistance) | ∓.01 | .02 | −.11 |
| STOL (% change in resistance) | ±.02 | .03 | −.01 |
| Load Life (% change in resistance) | | | |
| 1000 hours | ±.04 | .44 | −.01 |
| 2000 hours | .09 | .50 | 0 |

EXAMPLE II

Three batches of termination materials were made in the mnnaer described in Example I, with one batch containing 49% by volume of molybdenum, the second batch containing 63% by volume of molybdenum, and the third batch containing 77% by volume of molybdenum. The termination material of each of the batches were screen printed on substrates to form a pair of termination areas of the shape shown in FIG. 1. The termination areas were dried in an atmosphere of air at 150° C for ¼ hour. Some of the termination areas from each batch were then heated in air at 300° C to remove the organic binder, while others were not so heated. The termination areas were fired at 1180° C for a one hour cycle with some being fired in a nitrogen atmosphere and others being fired in a forming gas (95% hydrogen and 5% nitrogen) atmosphere. The resistances of the termination areas were then measured. A resistance material layer was then applied to each substrate between and overlapping the termination areas in the same manner as described in Example I. After the resistance material layers were fired and cooled, the resistances of the termination areas were again measured. Table II shows the resistance of each of the various termination areas before and after the resistance material layers were applied.

Table II

| | Resistance Before (ohms/square) | | | | Resistance After (ohms/square) | | | |
|---|---|---|---|---|---|---|---|---|
| Firing Atmosphere | Nitrogen | | Forming Gas | | Nitrogen | | Forming Gas | |
| Binder removal | Yes | No | Yes | No | Yes | No | Yes | No |
| 49% molybdenum | .13 | .09 | .07 | .06 | 4 | 6 | .4 | .3 |
| 63% molybdenum | .06 | .05 | .05 | .04 | 6 | 18 | .2 | .3 |
| 77% molybdenum | .04 | .03 | .03 | .03 | 12 | 18 | .4 | .5 |

EXAMPLE III

Three batches of a termination material were made in the same manner as described in Example II. Resistors were made by first applying by screen printing a vitreous enamel resistance material onto the surface of a plurality of flat substrates. The resistance material contained particles of tantalum nitride and tantalum as the conductive material and were applied in a rectangular shape as shown in FIG. 1. The resistance material layers were air dried at 150° C for ¼ hour, then heated at 350° C in an $N_2$ atmosphere for ½ hour to remove the organic binder, and then fired at 1150° C in a nitrogen atmosphere over a one hour cycle. Termination areas of the shape shown in FIG. 1 were then applied to each substrate using the termination materials of the three batches with the termination areas overlapping the resistance material layers. The termination areas were air dried at 150°C for ¼ hour and then fired in a nitrogen atmosphere over a one hour cycle. Some of each of the termination areas were fired at 850°C, some at 950° C and some at 1000° C. Table III shows the resistance of each of the various terminations.

Table III

| Firing Temperature | 850° C | 950° C | 1000° C |
|---|---|---|---|
| 49% molybdenum (ohms/square) | 1.7 | 0.1 | 0.1 |
| 63% molybdenum (ohms/square) | 1.3 | 02. | 0.07 |
| 77% molybdenum (ohms/square) | 1.6 | 0.1 | 0.07 |

EXAMPLE IV

A termination material was made in the manner described in Example I, and was applied to substrates to form termination areas in the manner described in Example I. A vitreous enamel resistance material containing tungsten carbide and tungsten particles as the conductive material was applied to the substrates in the manner described in Examle I, except that the resistance material layers were fired at 950° C over a ½ hour cycle.

The resistors were subjected to various tests including the STOL test, LTO test, and Load Life test described in Example I, and, in addition, to a temperature cycle test, a mixture test, and a 150° C no load test. The temperature cycle test (also known as thermal shock test) includes subjecting the resistors to a number of cycles of temperature changes with each cycle including first lowering the temperature to about −55° C, then raising it back to 25° C, then raising it to about 85° C, and then lowering the temperature back to 25° C, with the resistors being held at each temperature for a specified period of time. The resistance of the resistors is measured before and after the test to determine any change in resistance. For the moisture test, the resistors are placed under a load and subjected to a temperature cycling while in a high humidity. The resistance of the resistors is measured before and after the test to determine any change in resistance. For the 150° C no load test, the resistors are heated to about 150° C and held at that temperature for an extended period of time with no voltage load on the resistors. The resistors are then cooled back to room temperature and the resistance values measured to determine any change in resistance.

The results of the test for these resistors are shown in Table IV.

Table IV

| | Average | Span | |
|---|---|---|---|
| STOL (% change in resistance) | ±.03 | .18 | −.14 |
| Temperature Cycling (% change)ΔR | .07 | .19 | .02 |
| Moisture (% change)ΔR | −.37 | −.35 | −.40 |
| LTO (% change)ΔR | ±.01 | .05 | −.01 |
| 70° C Load Life (% change)ΔR | | | |
| 240 hours | ∓.05 | .09 | −.17 |
| 504 hours | ±.04 | .09 | −.13 |
| 1008 hours | ∓.07 | .16 | −.18 |
| 150° C No Load (% change)ΔR | | | |
| 264 hours | −.06 | .00 | −.11 |
| 504 hours | ∓.03 | .06 | −.07 |
| 1008 hours | ∓.05 | .08 | −.15 |

EXAMPLE V

A termination material was made in the manner described in Example I, and was applied to substrates to form termination areas in the manner described in Example I. A vitreous enamel resistance material containing an alloy of copper and nickel as the conductive particles, was applied to the substrates in the manner as described in Example I, except that the resistance material layers were heated at 350° C in a forming gas (95% hydrogen and 5% nitrogen) for ½ hour to remove the organic binder and was fired at 850° C in a nitrogen atmosphere over a ½ hour cycle. These resistors were subjected to the tests described in Examples I and IV and the results of these tests are shown in Table V.

Table V

| | Average | Span | |
|---|---|---|---|
| STOL (% change in resistance) | ∓.03 | .07 | −.29 |
| Temperature Cycling (% change)ΔR | ∓.01 | .01 | −.05 |
| LTO (% change)ΔR | ±.04 | .10 | −.02 |
| Moisture (% change)ΔR | .15 | .35 | .01 |
| 70° C Load Life (% change)ΔR | | | |
| 240 hours | ±.04 | .05 | −.17 |
| 504 hours | ±.05 | .10 | −.16 |
| 1032 hours | −.16 | −.06 | −.25 |
| 150° C No Load (% change)ΔR | | | |
| 96 hours | ±.10 | .26 | −.13 |
| 240 hours | ∓.15 | .09 | −.35 |
| 504 hours | ∓.11 | .44 | −.22 |
| 1008 hours | ±.34 | 1.00 | −.17 |

EXAMPLE VI

A termination material was made by mixing together particles of tungsten with the glass frit described in Example I, in the manner described in Example I. The termination material contained 59% by volume of the tungsten. The termination material was screen printed on flat substrates in the pattern shown in FIG. 1, to form termination areas. The termination areas were dried in air at 150° C for ¼ hour, and were then fired at 1180° C, in nitrogen, over a one hour cycle. A vitreous enamel resistance material containing tantalum nitride and tantalum as the conductive particles, was screen printed on the substrates between and overlapping the termination areas. The resistance material layers were dried in air at 150° C for ¼ hour, then heated at 350° C in $N_2$ for ½ hour to remove any organic binder, and then fired at 1150° C in nitrogen over a one hour cycle. The resistors were completed as described in Example I, and were subjected to the 150° C no load test described in Example IV. After 1137 hours, the resistors showed an average change in resistance of ±0.13 percent with the span being between −0.18 percent and +0.23 percent.

EXAMPLE VII

A termination material was made in the manner described in Example VI. The termination material was screen printed on substrates to form termination areas of the pattern shown in FIG. 3. The termination areas were air dried at 150° C for ¼ hour, then heated in a nitrogen atmosphere at 350° C for ½ hour to remove any organic binder, and then fired at 1150° C in a nitrogen atmosphere over a one hour cycle. A vitreous enamel resistance material containing tungsten carbide and tungsten as the conductive particles was screen printed on the substrate between and overlapping the termination areas. The resistance material layers were air dried at 150° C for ¼ hour, then heated at 350° C in a nitrogen atmosphere for ½ hour to remove any organic binder, and then fired at 950° C in a nitrogen atmosphere over a ½ hour cycle. The resistors were completed as described in Example I. The resistors were subjected to the tests described in Examples I and IV, and the results of these tests are shown in Table VII.

Table VII

| | Average | Span | |
|---|---|---|---|
| STOL (% change in resistance) | ∓.04 | .13 | −1.33 |
| Temperature Cycling (% change) ΔR | ±.05 | .24 | −.08 |
| Moisture (% change) ΔR | ∓.44 | 2.90 | −.36 |
| LTO (% change) ΔR | .08 | .28 | .04 |
| 70° C Load Life (% change) ΔR | | | |
| 240 hours | −.10 | −.01 | −.24 |
| 504 hours | ∓.05 | .05 | −.20 |
| 1008 hours | ∓.06 | .18 | −.21 |
| 150° C No Load (% change) ΔR | | | |
| 264 hours | ∓.18 | .08 | −2.82 |
| 504 hours | ∓.21 | .07 | −2.80 |
| 1008 hours | ±.23 | .42 | −2.70 |

EXAMPLE VIII

A termination material was made in the manner described in Example VI, and was screen printed on substrates to form termination areas as described in Example VII. A vitreous enamel resistance material containing particles of an alloy of copper and nickel as the conductive material, was screen printed on the substrates between and overlapping the termination areas. The resistance material layers were air dried at 150° C for ¼ hour, heated at 350° C in forming gas (95% nitrogen and 5% hydrogen) for ½ hour to remove any organic binder, and then fired at 850° C in nitrogen over a ½ hour cycle. The resistors were completed as described in Example I, and were subjected to the test described in Examples I and IV. The results of these tests are shown in Table VIII.

Table VIII

| | Average | Span | |
|---|---|---|---|
| STOL (% change in resistance) | ∓.04 | .08 | −.28 |
| Temperature Cycling (% change)ΔR | ∓.04 | .12 | −.25 |
| LTO (% change)ΔR | ∓.02 | .06 | −.07 |
| Moisture (% change)ΔR | ±.18 | 2.20 | −.18 |
| 70° C Load Life (% change)ΔR | | | |
| 1032 hours | ±.07 | .29 | −.10 |
| 150° C No Load (% change)ΔR | | | |
| 1008 hours | ±.07 | .19 | −.10 |

EXAMPLE IX

A vitreous enamel resistance material containing particles of tantalum nitride and tantalum as the conductive material was screen printed on flat substrates, in a rectangular pattern, as shown in FIG. 1. The resistance material layers were dried in air at 150° C for ¼ hour and fired at 1150° C in nitrogen. A termination material was made in the manner described in Example VI. The termination material was screen printed on the substrates to form termination areas as shown in FIG. 1 which overlapped the ends of the resistance material layers. The termination areas were air dried at 150° C for ¼ hour. Some of the termination areas were heated at 350° C in air for ½ hour to remove ay organic binder. The termination areas were fired in nitrogen over a one hour cycle. Some were fired at 950° C and some at 1000° C. Table IX shows the resistance of these termination areas.

Table IX

| Binder Removal | None | Yes | None |
|---|---|---|---|
| Firing Temperature ° C | 950 | 1000 | 1000 |
| Resistance (ohms/square) | 1 | .2 | .3 |

EXAMPLE X

Three batches of a termination material were made by mixing together particles of titanium and a glass frit of the composition described in Example I. The amount of titanium in the three batches was by volume 48%, 62% and 77% respectively. The termination materials were made in the manner described in Example I. The termination materials were screen printed on flat substrates to form termination areas of the shape shown in FIG. 1. The termination areas were air dried at 150° C for ¼ hour and then fired at 1180° C in nitrogen over a one hour cycle. A vitreous enamel resistance material was screen printed on each of the substrates between and overlapping the termination areas. The resistance material included particles of tantalum nitride and tantalum as the conductive material. The resistance material layers were air dried at 150° C for ¼ hour, then heated at 350° C in $N_2$ for ½ hour to remove any organic binder, and then fired at 1150° C in nitrogen over a one hour cycle. The termination areas containing 48% titanium had a resistance of about 1.2 ohms/square, the termination areas containing 62% titanium had a resistance of about 0.6 ohms/square, and the termination areas containing 77% titanium had a resistance of about 0.3 ohms/square.

EXAMPLE XI

Resistors were made using the same termination materials and resistance materials described in Example X. However, the resistance material layers were screen printed on the substrates first and after the resistance material layers were fired, the termination areas were screen printed on the substrates. The termination areas were fired at three different temperatures, 850° C, 950° C and 1000° C. The resistance of these termination areas is shown in Table XI.

Table XI

| Firing Temperature (° C) | 850 | 850 | 950 | 950 | 950 | 1000 | 1000 |
|---|---|---|---|---|---|---|---|
| % Titanium by volume | 48 | 77 | 48 | 62 | 77 | 48 | 77 |
| Resistance (ohms/square) | 5 | .8 | 4 | 1.5 | .5 | 3 | .6 |

EXAMPLE XII

A termination material was made by mixing together particles of tantalum and a glass frit of the composition described in Example I with the termination material containing 48% by volume of the tantalum. The termination material was made in the same manner as described in Example I. The termination material was screen printed on substrates to form termination areas of the pattern shown in FIG. 1. The termination areas were air dried at 150° C for ¼ hour, and then fired at 1180° C in nitrogen over a one hour cycle. A vitreous enamel resistance material containing particles of tantalum nitride and tantalum as the conductive material was screen printed on the substrates in the pattern shown in FIG. 1. The resistance material layers were air dried at 150° C for ¼ hour, then heated in $N_2$ at 350° C for ½ hour to remove any organic binder, and then fired at 1150° C in nitrogen over a one hour cycle. These termination areas had a resistance of 2 ohms/sqaure.

EXAMPLE XIII

Resistors were made of the same termination material and resistance material described in Example XII and in the same manner except that the resistance material was screen printed on the substrates first, and after being fired, the termination material was screen printed on the substrates so as to overlap the ends of the resistance material layer. Also, the termination material layers were fired at different temperatures, i.e. 850°, 950°, 1000° and 1100° C. Table XIII shows the resistance of the termination areas fired at the different temperatures.

Table XIII

| Firing Temperature (° C) | Termination Resistance (ohms/square) |
|---|---|
| 850 | 10 |
| 950 | 5 |
| 1000 | 6 |
| 1100 | 3 |

The present invention may be embodied in other specific forms without departing from the spirit or essential attributes thereof, and accordingly, reference should be made to the appending claims, rather than to the foregoing specification as indicating the scope of the invention.

What is claimed is:

1. An electrical termination material comprising a mixture of a glass frit and a conductive phase, said conductive phase consisting essentially of particles of a metal selected from the group consisting of molybdenum, tungsten, tantalum and titanium.

2. An electrical device including a substrate of an electrical insulating material and a termination area on a surface of said substrate, said termination area comprising a layer of glass having embedded therein a conductive phase, said conductive phase consisting essentially of particles of a metal selected from the group consisting of molybdenum, tungsten, tantalum and titanium.

3. An electrical resistor comprising a substrate of an electrical insulating material, a pair of spaced termination areas on a surface of said substrate, each of said termination areas comprising a layer of glass having embedded therein a conductive phase, said conductive phase consisting essentially of particles of a metal selected from the group consisting of molybdenum, tungsten, tantalum and titanium, and a resistance material layer on said surface of the substrate between and contacting said termination areas.

4. An electrical resistor in accordance with claim 3 in which the resistance material layer comprises a layer of glass having embedded therein particles of a conductive material.

5. An electrical resistor in accordance with claim 4 in which the conductive particles in the resistance material layer are selected from the group consisting of a mixture of tantalum nitride and tantalum, a mixture of tungsten carbide and tungsten, and an alloy of copper and nickel.

6. An electrical resistor in accordance with claim 3 in which the resistance material layer overlies at least a portion of each of the termination areas.

7. An electrical resistor in accordance with claim 6 in which a portion of the termination areas not covered by the resistance material layer is coated with a conductive metal which is easily wetted by solder.

8. An electrical resistor in accordance with claim 3 in which each of the termination areas overlies a portion of the resistance material layer.

9. An electrical resistor in accordance with claim 8 in which each of the termination areas is at least partially coated with a conductive metal which is easily wetted by solder.

10. A method of making an electrical device wherein a vitreous enamel termination composition is applied to a substrate comprising the steps of preparing a vitreous enamel termination composition comprising a glass frit and a conductive phase, said conductive phase consisting essentially of finely divided conductive particles selected from the group consisting of molybdenum, tungsten, tantalum and titanium, applying a layer of the composition to an insulating substrate, firing the coated substrate in a non oxidizing atmosphere at a temperature sufficient to form an adherent vitreous composite, and cooling the coated substrate to form a termination thereon having a glass matrix with conductive particles dispersed therein.

11. The method of claim 10 in which the terminal composition is fired in nitrogen at a temperature between about 1100° and 1200° C.

12. The method of claim 10 which includes the step of forming on the substrate a vitreous enamel resistor comprising a layer of glass having particles of a conductive material dispersed throughout the glass layer, which is contacted by the termination.

13. The method of claim 12 in which the conductive particles of the resistor are selected from the group consisting of a mixture of tantalum nitride and tantalum, a mixture of tungsten carbide and tungsten, and an alloy of copper and nickel.

14. The method of claim 12 in which the vitreous enamel resistor is formed on the substrate after the application and firing of the termination layer on the substrate.

15. The method of claim 12 in which the vitreous enamel resistor is formed by applying and firing a resistive layer on the substrate before the application and firing of the termination layer on the substrate in contact with the resistor.

16. An electrical termination material comprising a mixture of a glass frit and particles of a metal selected from the group consisting of molybdenum, tungsten, tantalum and titanium, and in which the metal particles are present in the amount of 45% to 85% by volume.

17. An electrical termination material in accordance with claim 16 in which the metal particles are present in the amount of 45% to 65% by volume.

18. An electrical device including a substrate of an electrical insulating material and a termination area on a surface of said substrate, said termination area comprising a layer of glass having embedded therein particles of a metal selected from the group consisting of molybdenum, tungsten, tantalum and titanium, and in which the metal particles are present in the termination area in the amount of 45% to 85% by volume.

19. An electrical device in accordance with claim 18 in which the metal particles are present in the termination area in the amount of 45% to 65% by volume.

20. An electrical resistor comprising a substrate of an electrical insulating material, a pair of spaced termination areas on a surface of said substrate, each of said termination areas comprising a layer of glass having embedded therein particles of a metal selected from the group consisting of molybdenum, tungsten, tantalum and titanium, the metal particles being present in the termination areas in the amount of 45% to 85% by volume, and a resistance material layer on said surface of the substrate between and contacting said termination areas.

21. An electrical resistor in accordance with claim 20 in which the metal particles are present in the termination areas in the amount of 45% to 65% by volume.

22. A method of making an electrical device wherein a vitreous enamel termination composition is applied to a substrate comprising the steps of preparing a vitreous enamel termination composition comprising a glass frit and finely divided conductive particles selected from the group consisting of molybdenum, tungsten, tantalum and titanium, the metal particles of the termination composition being present in the amount to 45% to 85% by volume, applying a layer of the composition to an insulating substrate, firing the coated substrate in a non oxidizing atmosphere at a temperature sufficient to form an adherent vitreous composite, and cooling the coated substrate to form a termination thereon having a glass matrix with conductive particles dispersed therein.

23. The method of claim 22 in which the metal particles of the termination composition are present in the amount of 45% to 65% by volume.

* * * * *